United States Patent [19]

Peinsipp

[11] Patent Number: 4,712,692

[45] Date of Patent: Dec. 15, 1987

[54] STOWABLE SHELF/RACK ASSEMBLY

[75] Inventor: Alice A. Peinsipp, Westchester, Ill.

[73] Assignee: Selfix, Inc., Chicago, Ill.

[21] Appl. No.: 22,672

[22] Filed: Mar. 6, 1987

[51] Int. Cl.[4] ..... A47F 5/08

[52] U.S. Cl. ..... 211/119; 211/181; 211/2

[58] Field of Search ..... 211/119, 86, 88, 90, 211/113, 16, 106, 2, 181, 150, 149

[56] References Cited

U.S. PATENT DOCUMENTS

| | | | |
|---|---|---|---|
| 416,489 | 12/1889 | Parrish | 211/106 X |
| 2,271,941 | 2/1942 | Kemmitt | 211/90 X |
| 4,162,730 | 7/1979 | Steere, Jr. et al. | 211/119 |

FOREIGN PATENT DOCUMENTS

| | | | |
|---|---|---|---|
| 805348 | 12/1958 | United Kingdom | 211/106 |
| 850997 | 10/1960 | United Kingdom | 211/106 |

*Primary Examiner*—Reinaldo P. Machado

*Assistant Examiner*—Sarah A. Lechok Eley

*Attorney, Agent, or Firm*—Dressler, Goldsmith, Shore, Sutker & Milnamow, Ltd.

[57] ABSTRACT

A stowable shelf/rack assembly having a shelf or rack member for supporting articles placed thereon or hung or depending therefrom, and a pair of hangers pivotally connected to either side of the shelf member and pivotable between a first position in which the hangers are oriented transverse to the rack with a first hook portion extending rearwardly of the assembly and adapted to hang on and be supported by a bar or other member affixed to a wall or similar surface, and a second position in which the major portion of each of the hangers lies generally in the same plane as and rests on the rack with a second hook portion extending rearwardly from the front of the assembly and engageable when said hangers are in the second position with a shelf or other support member for supporting the collapsed assembly in close contact with one surface thereof.

11 Claims, 6 Drawing Figures

FIG. 1
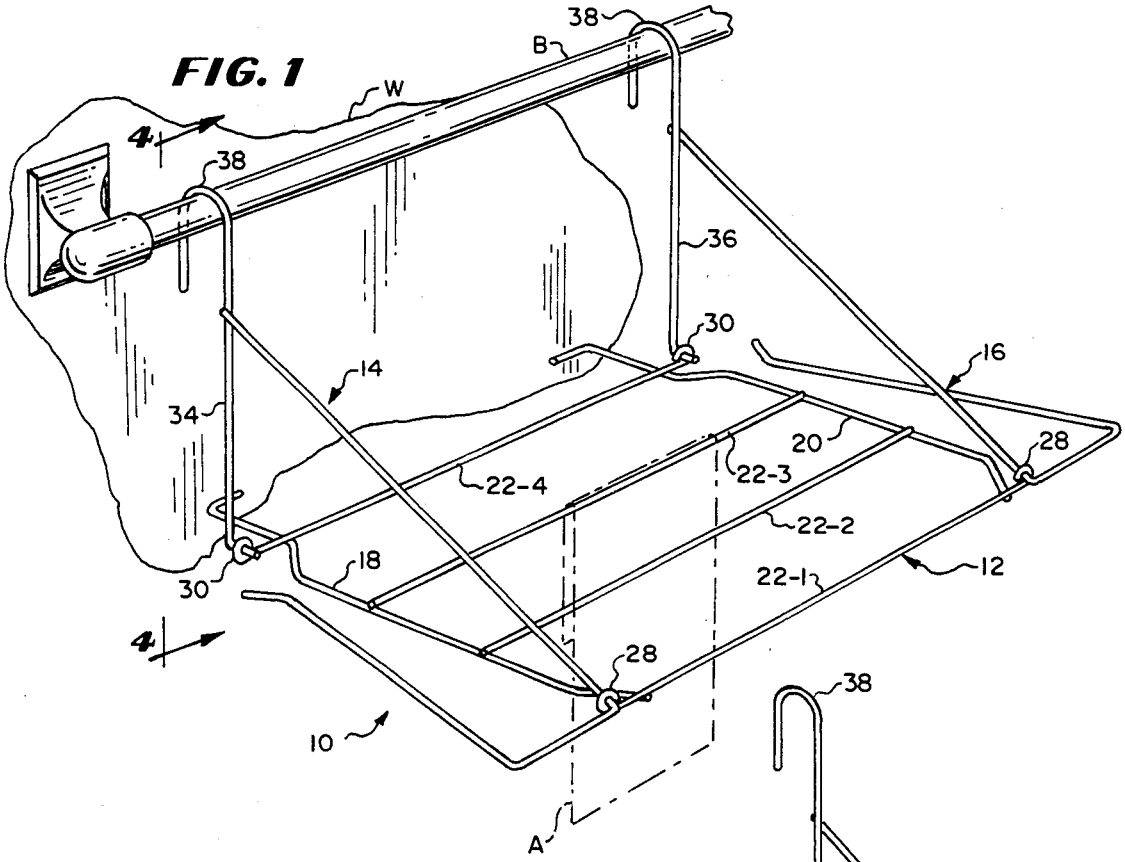
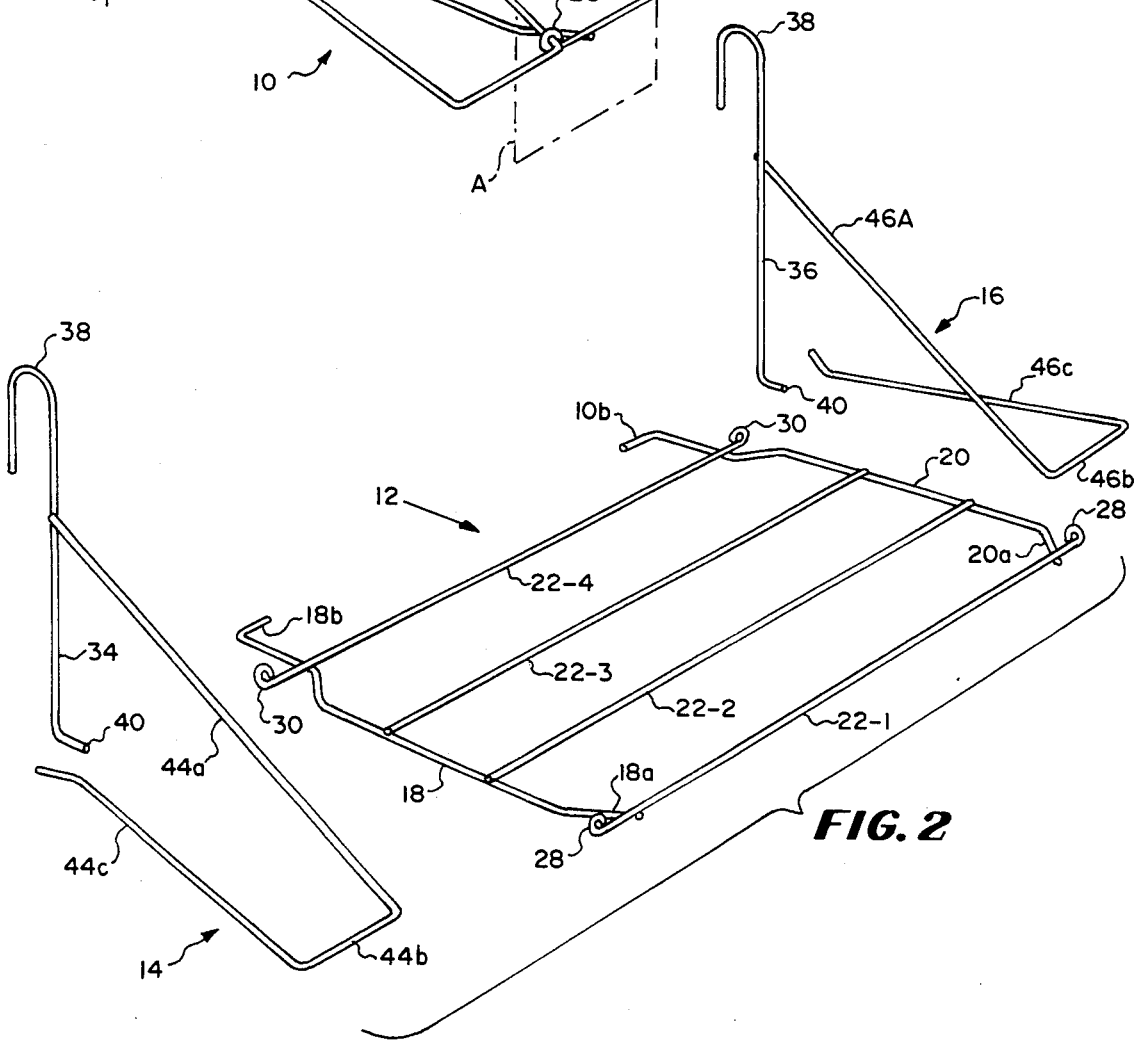
FIG. 2

STOWABLE SHELF/RACK ASSEMBLY

FIELD OF THE INVENTION

The present invention relates generally to convenience items such as shelves, baskets, and racks typically constructed from coated wire and, more particularly, to an easily used, stowable shelf/rack assembly.

BACKGROUND OF THE INVENTION

The desirability of providing products that can be used for short periods or on a temporary basis for various purposes is well-known. There is always a need for a temporary shelf or a rack for hanging clothes and other similar articles therefrom, e.g., for drying, or for some other similar purposes. This is particularly true when space is limited. The inadequate availability of such conveniences is an often heard complaint. While towel bars mounted to walls are used for hanging articles to be dried, the number of these items is often limited, again, particularly true when space is limited.

Furthermore, even when temporary racks are used, the problem exists of what to do with them when not in use. Storage space is also often limited or not available.

Thus, it would be desirable to provide an easily usable, stowable shelf/rack assembly capable of being erected rapidly and without difficulty, and which could have a variety of uses, such as, e.g., hanging or draping articles, such as clothing or other personal items, over elements thereof to facilitate drying of these articles. It would also be highly desirable to provide such a shelf-/rack assembly which can be easily, conveniently, and rapidly stored or stowed in an out-of-the-way location without taking up otherwise useful space.

The usefulness and versatility of such a shelf/rack assembly would be enhanced if it could be erected quickly and without difficulty, if it were usable in a variety of locations, if it would not require installation in order to be useful, and if it could be readily taken down and conveniently stowed. Such a low-cost, simply constructed, and useful shelf/rack assembly is likely to be highly appreciated by the consumer.

SUMMARY OF THE INVENTION

In accordance with the present invention, there is provided and disclosed an easily erected, stowable shelf/rack assembly. Such a shelf/rack assembly has various uses. It can be used, for example, as an extra shelf, as a rack for drying clothes and other articles placed thereon or hung therefrom. A shelf/rack assembly incorporating the present invention is conveniently and easily used, is relatively inexpensive, and can be easily and rapidly taken down and stowed away unobtrusively and out of the way.

In one disclosed embodiment of the present invention the shelf/rack assembly is constructed of plastic-coated wire and includes a shelf or rack member or portion having a plurality of elongated members on which articles can rest, or from which they can be hung or draped, e.g., to facilitate drying. The shelf/rack assembly incorporating the present invention includes a pair of sides or hanger members pivotally connected to the shelf portion which provide a dual function. The hangers support the erected shelf/rack assembly in its operative position, and also support the collapsed shelf/rack assembly when stowed. While the stowable shelf/rack assembly incorporating the present invention is preferably constructed from a plastic-coated or plated wire for ease of economical fabrication, tt should be recognized that the shelf/rack assembly could be made differently, for example, it could be molded or assembled from molded parts.

More specifically, a shelf/rack assembly incorporating the present invention includes a shelf or rack generally rectangular in plan view, which is formed by a pair of spaced apart side or frame members interconnected by a plurality of spaced apart transverse support or hanging members. The transverse support members are connected at or adjacent their opposite ends to the frame members. One of the transverse members may extend between and be connected to the frame members at or adjacent to the free or forward end thereof. The rearmost transverse member may be spaced from the rear or inner ends of the frame members. Ends of selected ones of the transverse members are formed to pivotally receive the lower connecting portion of the hanger members.

Thus, the sides or hanger members are pivotally supported in and by corresponding portions of the shelf or rack. The hangers are capable of pivoting between an erected, operative position in which the hangers are oriented in a plane generally transverse to the plane of the shelf, and a collapsed or stowable position where a major portion of each of the hanger members lies on or along the surface of the shelf.

The hanger members are generally triangular in appearance. Each of the hangers is formed by a generally straight rear leg portion and a generally U-shaped forward strut portion. One end of the rear leg portion, the upper end in the erected position, is formed into a hook extending rearwardly thereof. The other or lower end of the rear leg portion defines a forwardly extending projection adapted to pivotally engage and interconnect with the rear portion of the shelf. The end of one leg of the U-shaped strut is connected to the rear leg at a point spaced from the lower end thereof. The other, closed end of the strut leg, pivotally engages the forward portion of the shelf.

Thus, the rear leg portion, the side or frame of the shelf, and the first leg of the strut define a triangle, typically a right triangle. When erected, the plane of this triangle is generally normal to the plane of the shelf and extends up therefrom. In this erected position, the base of the U-shaped strut extends laterally out from and generally in the plane of the shelf. The second leg of the strut, also in the same plane, extends rearwardly of the assembly to form an additional support member from which articles can be hung. The two hangers, the left and right hangers, are mirror images of each other.

In the erected position, the hooks at the upper ends of the rear legs are adapted to be hung on an appropriate support member, such as a towel bar.

The stowable shelf/rack assembly incorporated in the present invention may be configured for stowage by pivoting the side hanger members, so that the rear hook-defining portion and the first leg of the strut are disposed on the surface of the shelf. In this position, the hooks and the second legs of the U-shaped struts are disposed in a plane substantially normal to the plane of the shelf and define a rearwardly opening hook adapted to engage a shelf or other supporting member and to permit the shelf/rack assembly of the present invention to be supported therefrom in contact with a surface thereof without utilizing otherwise useful space.

Thus, when not in use, the shelf/rack assembly of the present invention is stowable out of the way and in minimal space. The U-shaped struts can be received over a suitable support, such as a shelf or the towel bar itself. When inserted over a front end of the shelf, the shelf/rack assembly of the present invention is supported out of the way against the underside of the shelf. Thus stowed, the shelf/rack assembly of the present invention takes up almost no room, and being underneath the shelf does not utilize what is otherwise useful space.

The shelf/rack assembly of the present invention is easily erected as a temporary shelf and/or drying rack. It can be erected and installed in place almost instantly with little or no effort, and can be collapsed and stowed out of the way with almost no space requirement and using what is often unused or unusable areas.

Numerous other advantages and features of the present invention will become readily apparent from the following detailed description of the invention and the embodiments thereof, from the claims, and from the accompanying drawings in which the details of the invention are fully and completely disclosed as a part of this specification.

BRIEF DESCRIPTION OF THE DRAWINGS

FIG. 1 is a perspective view of the shelf/rack assembly of the present invention in its erected and installed condition;

FIG. 2 is an exploded view showing the components of the shelf/rack assembly of the present invention;

DETAILED DESCRIPTION OF SPECIFIC EMBODIMENT

Figure 3:
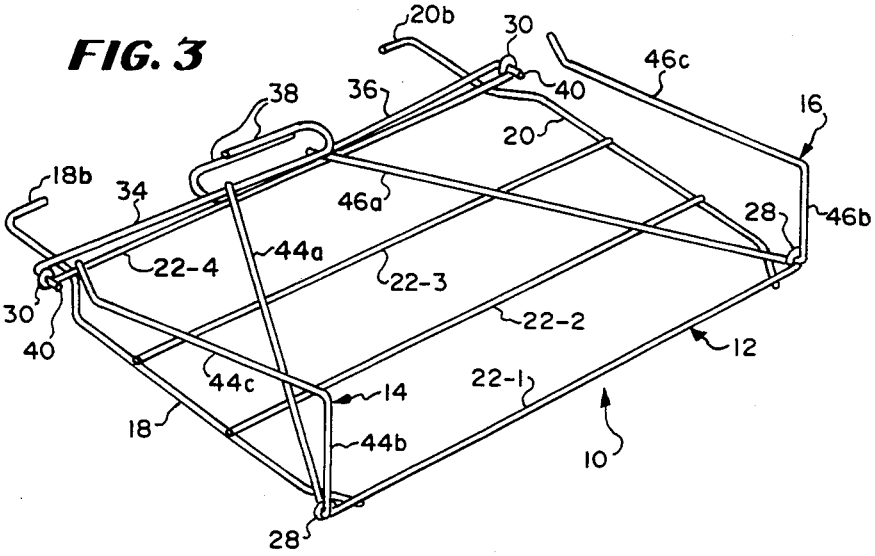
FIG. 3 shows the shelf/rack assembly of the present invention in its collapsed, stowable configuration.

While this invention is susceptible of embodiment in many different forms, there is shown in the drawing, and will be described herein in detail, a specific embodiment thereof with the understanding that the present disclosure is to be considered as an exemplification of the principles of the invention and is not intended to limit the invention to the specific embodiment illustrated.

The shelf/rack assembly 10 shown in the drawing is preferably constructed of plastic-coated metal wire members which are appropriately shaped to form the assembly of the present invention in its desired configuration. The plastic coating may comprise vinyl or a like material which is suitably durable and corrosion-resistant, and which is typically available in a wide variety of colors for enhancing the aesthetic appeal of the product. The shelf/rack assembly is fabricated in accordance with known methods, typically comprising suitable interconnection of the various members, such as by welding, with the entire arrangement thereafter being coated. Alternatively, the shelf/rack assembly may be plated with a suitable metal coating in lieu of the plastic coating. Another alternative, the components of the assembly may be molded and the various components connected together. If molded, multiple elements may be molded as unitary components rather than welding the various elements together to form the components.

As shown in the drawing, the shelf/rack assembly 10 includes three basic elements—the shelf or rack member 12 and a pair of side hanger members, left hanger 14 and right hanger 16. The hangers 14, 16 are engageable with and pivotally connectable to the shelf 12. The shelf or rack member 12 is constructed of a pair of spaced apart sides or frame members 18, 20, interconnected by a plurality of transverse spaced apart support members 22. Four support members, 22-1, 22-2, 22-3, and 22-4, are shown. The support members 22 are connected at or adjacent the ends thereof to the sides or frame members 18, 20. The forward or outboardmost transverse support member 22-1 is connected to the frames 18, 20 at or adjacent to the forward or free ends thereof. The free ends **18*a*, 20*a* of the frame members 18, 20 are tapered inwardly and are connected to forwardmost transverse member 22-1 inside the ends thereof. The ends of the forwardmost transverse member 22-1 are formed as closed loops 28 to define apertures for receiving a portion of the hangers 14, 16**, as described below.

Figure 4:
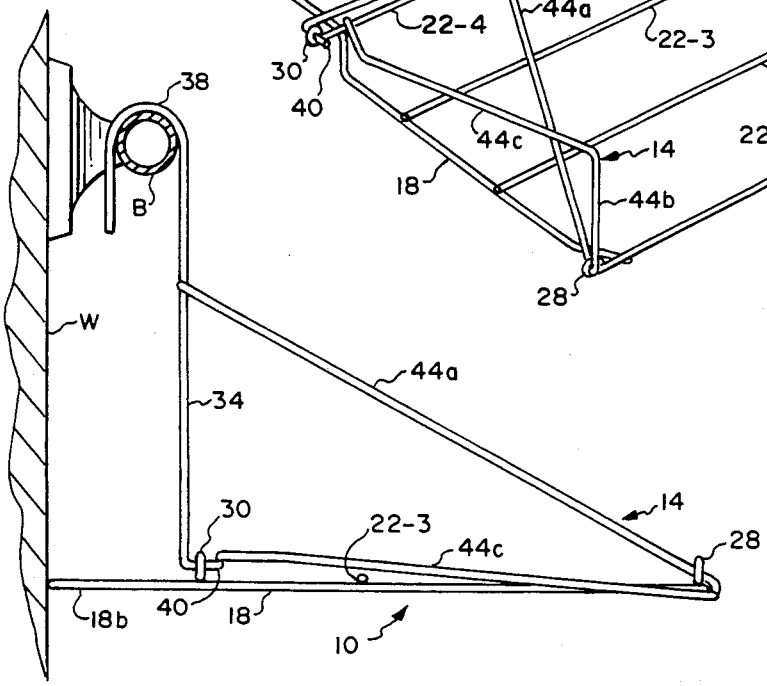
FIG. 4 is a sectional view taken along lines 4—4 of FIG. 1.

The rearmost transverse support member 22-4 is also formed with loops 30 at the ends thereof to receive another portion of each of the hangers 14, 16. The rear support member 22-4 is connected to the frame members 18, 20 at a point spaced from the inward or rear ends **18*b*, 20*b* thereof. In this configuration, the rear ends 18*b*, 20*b* of the frame members 18, 20 project rearwardly of the innermost support member 22-4 to define or form rearward projections adapted to abut against a wall or other surface W when the shelf/rack assembly 10 is hung in its erected or operative position from a towel bar B or other support affixed to the wall W and spaced therefrom, as shown in FIGS. 1 and 4. In this fashion, the shelf/rack assembly 10** extends outwardly from the wall W in a generally horizontal plane, whereby one or more articles A may be placed thereon or draped over the elements thereof as desired.

The shelf 12 is supported by the pair of hangers 14, 16 generally triangular in appearance. Each of the hangers 14, 16 is defined by a rear leg 34, 36, respectively, which, in their operative position as shown in FIGS. 1, 2, and 4, are oriented in planes substantially perpendicular to the plane of the shelf 12. The upper ends of each of the rear legs 34, 36 are formed as hooks 38 extending rearwardly of the assembly 10 and adapted to slide or be placed over and hang from a towel bar B or other similar member normally attached or otherwise affixed to a wall W or similar surface. The lower ends of each of the back legs 34, 36 are formed with forwardly extending projections 40 adapted to pass through the apertures 30 formed at the ends of the rearmost support member 22-4 for pivotal engagement therewith.

Each of the hangers 14, 16 includes generally U-shaped struts 44, 46, respectively. The two struts, left strut 44 and right strut 46, are mirror images of each other. The first leg **44*a*, 46*a* of each strut 44, 46 is connected to a corresponding back leg 34, 36, respectively, at a point spaced from the ends thereof, which, as shown in the drawing, is about two-thirds of the way up from the bottom of the back legs. The first legs 44*a*, 46*a* of the struts 44, 46 are oriented at an angle to the back legs 34, 36 to define with the frames 18, 20 a right triangle when the assembly 10 is erected, as shown in FIGS. 1 and 4. The forward portion, or closed end, of each of the legs 44*a*, 46*a* passes through an aperture defined by each of the loops 28 formed in the ends of support member 22-1. The base members 44***b*, 46*b* of the U-shaped struts 44, 46 are formed at right angles to the other two legs, 44*a*, 44*c* and 46*a*, 46*c*, respectively, and extend laterally out from the shelf 12, as shown in FIGS. 1, 2, and 4. The second leg 44*c*, 46*c* of each of the struts 44, 46 extends back from the outer end of the base 44*b*, 46*b* to define an additional hanging member when the assembly 10 is erected.

The hangers 14, 16 are retained in place because the projections 40, 42 at the bottom of the back legs 32, 34 are oriented in the opposite direction from the closed end of the struts 44, 46. To ensure proper retention, the hangers 14, 16 can be biased somewhat so a force must be used to separate the hangers 14, 16 from the shelf 12.

As shown in FIGS. 1 and 4, the free ends of the U-shaped struts 44, 46 extend generally in the plane of and are disposed outwardly of the shelf 12 when the assembly is installed, while the hooks 36, 38 engage a towel bar, bar, or other similar member, with the rear inner ends 18*b*, 20*b* of the frames 18, 20 abutting against the wall surface W.

Figure 6:
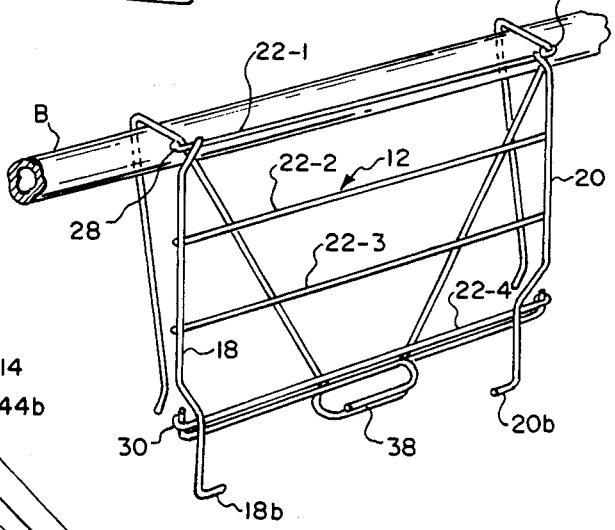
FIG. 6 shows the collapsed shelf/rack assembly of the present invention in a stored position on a towel bar.
Figure 5:
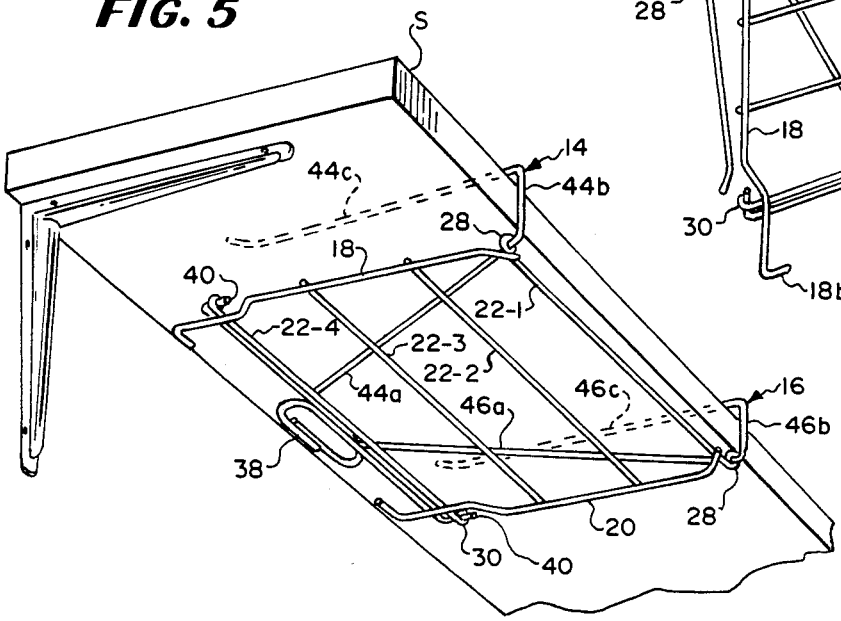
FIG. 5 shows the shelf/rack assembly of the present invention stowed underneath a shelf.

When it is desired to stow the assembly, the hangers 14, 16 are pivoted so that the rear legs 32 lie on and substantially in the plane of the shelf 12, as shown in FIGS. 3, 5, and 6. In this position, the struts 44 are oriented so the bases 44*b*, 46*b* are disposed in a plane substantially perpendicular to the plane of the shelf 12. This facilitates the hanging of the "collapsed" assembly 10 from a shelf S for storage, as shown in FIG. 5, or from the bar B, as shown in FIG. 6. The depth of the hangers 14, 16 are such that the assembly 10 is retained against the underside of the shelf S. Thus, the stowed assembly occupies space that is typically not otherwise normally usable. Alternatively, as shown in FIG. 6, the assembly 10 may be conveniently folded up and hung from the bar B. In this position, the bar can be used as normal for towels, and the assembly 10 is out of the way and not in a position where it creates an obstruction.

Thus, there has been disclosed a conveniently stowable shelf/rack assembly capable of being easily and rapidly erected and used, and being capable of a rapid and easy storage and stowage without requiring significant space allocations. The shelf/rack assembly of the present invention is thus usable for a variety of purposes when installed, such as for drying clothes, hanging over various components thereof, or as a temporary shelf for supporting articles thereon.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. A stowable shelf/rack assembly comprising:

a rack member for supporting articles placed thereon or hung therefrom; and hanger means connected to either side of said rack member, and pivotable between a first position in which said hanger means are oriented generally transverse to said rack member, and a second position in which a major portion of said hanger means lies generally in the same plane as and rests on said rack member, said hanger means including a first hook portion extending rearwardly of the assembly and adapted when said hanger means is in said first position to hang on and be supported by a bar or other member affixed to and spaced from a substantially vertical planar surface, and a second hook portion integral with said first hook portion and extending rearwardly from a point adjacent the front of the assembly and engageable when said hanger means is in said second position with a substantially horizontal planar support member for supporting the collapsed assembly in close contact with one substantially horizontal surface thereof for stowage.

2. A shelf/rack assembly as claimed in claim 1, wherein:

said rack member is comprised of a plurality of spaced apart frame members arranged in generally parallel relation, and a plurality of spaced apart support members extending between and affixed to said frame members, the ends of selected ones of said support members defining apertures for pivotally receiving a portion of said hanger means.

3. A shelf/rack assembly as claimed in claim 2, wherein:

said hanger means comprises a pair of hangers each having a leg member pivotally engaging said apertures in said rack member and defining said first hook means extending rearwardly of said assembly.

4. A shelf/rack assembly as claimed in claim 3, wherein:

said hanger means includes a strut member affixed to said leg means and extending forwardly of said assembly and pivotally engaging an aperture adjacent the front edge of said rack, said strut member defining said second hook means.

5. A shelf/rack assembly as claimed in claim 1, wherein:

said first and second hook portions are oriented in substantially orthogonal planes.

6. A shelf/rack assembly as claimed in claim 5, wherein:

said first hook portion lies in a plane transverse to the plane of said rack member when said hanger means is in said first position and lies on said rack member and generally in the plane thereof when said hanger means is in said second position.

7. A shelf/rack assembly as claimed in claim 6, wherein:

said second hook portion lies generally in the plane of said rack member and outside the periphery thereof when said hanger means is in said first position and lies in a plane transverse to and spaced above the plane of said rack member when said hanger means is in said second position.

8. A shelf/rack assembly comprising:

a rack member comprised of a pair of spaced apart, elongate frame members arranged in generally parallel relation, one end of each of said frame members being offset towards each other, and a plurality of spaced apart support members extending between and affixed to said frame members, the ends of selected ones of said support members defining apertures; and a pair of hangers pivotally connected to said rack member for movement between first and second positions; said hangers defining first hook means extending rearwardly of said assembly and adapted to engage and support the assembly from a bar or elongated support member affixed to and spaced from a wall surface when said hangers are in said first position, said hangers defining a second hook means oriented in a plane substantially normal to the plane of said first hook means, and operative when said hangers are in said second position to be received over the edge of a shelf or other member for stowage.

9. An assembly as claimed in claim 8, wherein:

each of said hangers is comprised of a back leg member and a strut member connected thereto, each of back leg members defining at one end thereof said first hook means and defining at the other end thereof projection means engageable with one of the apertures on said rack for pivoting connection thereto.

10. An assembly as claimed in claim 9, wherein:

each of said strut members is U-shaped with a pair of legs and a base, each of said strut legs being angularly offset one with respect to the other, the ends of one of said strut legs being connected to said back leg member and the other of said legs being laterally offset outwardly from the rack to define a hanging member lying generally in the plane of said rack.

11. An assembly as claimed in claim 10, wherein:

said other leg of each of said strut member defines said second hook means when said strut is rotated to said second position in which said back leg member and said first strut leg member rest on the surface of said rack.

* * * * *